US011585528B2

(12) United States Patent
George et al.

(10) Patent No.: US 11,585,528 B2
(45) Date of Patent: Feb. 21, 2023

(54) APPARATUS AND METHOD FOR A BURNER ASSEMBLY

(71) Applicant: Power Flame Incorporated, Parsons, KS (US)

(72) Inventors: Kenneth Ray George, Parsons, KS (US); Michael Joseph Purdon, Coffeyville, KS (US); Michael Ryan Martinie, McCune, KS (US)

(73) Assignee: Power Flame Incorporated, Parsons, KS (US)

( * ) Notice: Subject to any disclaimer, the term of this patent is extended or adjusted under 35 U.S.C. 154(b) by 360 days.

(21) Appl. No.: 16/715,372

(22) Filed: Dec. 16, 2019

(65) Prior Publication Data

US 2020/0191381 A1 Jun. 18, 2020

Related U.S. Application Data

(60) Provisional application No. 62/779,834, filed on Dec. 14, 2018.

(51) Int. Cl.
*F23C 1/08* (2006.01)
*F23C 3/00* (2006.01)
(Continued)

(52) U.S. Cl.
CPC ..... *F23C 1/08* (2013.01); *F23C 3/002* (2013.01); *F23C 7/008* (2013.01); *F23D 14/36* (2013.01);
(Continued)

(58) Field of Classification Search
CPC ..... F23C 1/08; F23C 2900/03005; F23C 2900/06042; F23C 3/002; F23C 7/008;
(Continued)

(56) References Cited

U.S. PATENT DOCUMENTS 1,640,728 A * 8/1927 Scott ..... F23D 11/001 239/427.5
1,797,570 A * 3/1931 Ferguson ..... F23D 17/00 431/178
(Continued)

FOREIGN PATENT DOCUMENTS

DE 3011287 A1 * 10/1981 ..... F23D 14/36

*Primary Examiner* — Michael G Hoang
*Assistant Examiner* — Logan P Jones
(74) *Attorney, Agent, or Firm* — Chambliss, Bahner & Stophel, P.C.; Stephen D. Adams

(57) ABSTRACT

A burner assembly having a blower housing, a blower to supply air to the burner assembly, a blast tube having a longitudinal axis, a fuel source to supply fuel to the burner assembly, a center tube that is substantially parallel to the longitudinal axis and conveys air and fuel to a center tube burner end opening, a plurality of premix tubes, each of which is substantially parallel to the longitudinal axis and conveys air and fuel to a premix tube burner end opening, a diffuser that is disposed in the center tube near the center tube burner end opening, a nozzle that is disposed in the center tube substantially perpendicular to the diffuser. The center tube air and fuel mixture is fuel rich and the premix tubes air and fuel mixture is fuel lean. A method for burning the center tube air and fuel mixture and the premix tubes mixtures.

11 Claims, 2 Drawing Sheets

(51) Int. Cl.

| | |
|---|---|
| ***F23C 7/00*** | (2006.01) |
| ***F23D 14/36*** | (2006.01) |
| ***F23D 14/64*** | (2006.01) |
| ***F23K 5/00*** | (2006.01) |
| ***F23D 14/34*** | (2006.01) |
| ***F23D 14/70*** | (2006.01) |
| ***F23D 14/02*** | (2006.01) |

(52) U.S. Cl.
CPC ..... *F23D 14/64* (2013.01); *F23K 5/00* (2013.01); *F23C 2900/03005* (2013.01); *F23C 2900/06042* (2013.01); *F23D 2900/00014* (2013.01)

(58) Field of Classification Search
CPC ..... F23D 14/36; F23D 14/64; F23D 2900/00014; F23K 5/00
See application file for complete search history.

(56) References Cited

U.S. PATENT DOCUMENTS 2,120,626 A * 6/1938 Powers ..... F23D 11/001 431/265
2,263,170 A * 11/1941 Haedike ..... F23D 14/36 431/278
2,500,787 A * 3/1950 Lelgemann ..... F23D 11/001 431/264
2,744,568 A * 5/1956 Johnson ..... F23D 17/002 431/265
2,821,246 A * 1/1958 Ide ..... F23D 11/001 431/60
2,865,440 A * 12/1958 Warnecke ..... F23D 17/002 239/400
3,111,979 A * 11/1963 Peoples ..... F23D 17/002 431/265
3,227,202 A * 1/1966 Morgan ..... F23D 14/36 431/185
4,047,879 A * 9/1977 Mitchell ..... F23D 11/001 431/183
5,387,100 A * 2/1995 Kobayashi ..... F23C 6/045 431/10
5,409,373 A * 4/1995 Phillips ..... F23D 11/001 431/208
5,460,514 A * 10/1995 Toyoshima ..... F23D 11/001 431/183
6,036,480 A * 3/2000 Hughes ..... F23D 14/24 122/249
11,187,407 B2 * 11/2021 Braig ..... F23D 14/70

* cited by examiner

APPARATUS AND METHOD FOR A BURNER ASSEMBLY

CROSS-REFERENCES TO RELATED APPLICATIONS/PATENTS

This application relates back to and claims the benefit of priority from U.S. Provisional Application for Patent Ser. No. 62/779,834 titled "Burner Assembly" and filed on Dec. 14, 2018.

FIELD OF THE INVENTION

The present invention relates generally to apparatuses and methods for burner assemblies, and particularly to apparatuses and methods for burner assemblies for the production of steam and hot water and for the commercial and industrial application of heat.

BACKGROUND AND DESCRIPTION OF THE PRIOR ART

It is known to use burner assemblies for the production of steam and hot water. Conventional burner assemblies and methods, however, suffer from one or more disadvantages. For example, conventional burner assemblies and methods produce excessive amounts of the undesirable combination of nitric oxide (NO) and nitrogen dioxide (NO2) (collectively NOx). As a result, conventional burner assemblies and methods require either expensive and complex external flue gas recirculation piping and controls or burner geometry using internal flue gas recirculation systems to lower NOx emission levels. Conventional burner assemblies and methods also may require undesirably high amounts of excess oxygen to reduce NOx emission levels. As a result, conventional burner assemblies and method have undesirably low combustion efficiencies. Further, conventional burner assemblies and methods may produce undesirable acoustic coupling. Still further, the burner heads in conventional burner assemblies and methods using internal flue gas recirculation are undesirably located within the combustion chambers.

It would be desirable, therefore, if an apparatus and method for a burner assembly could be provided that would not produce excessive amounts of the undesirable combination of nitric oxide (NO) and nitrogen dioxide (NO2) (collectively NOx). It would also be desirable if such an apparatus and method for a burner assembly could be provided that would not require either expensive and complex external flue gas recirculation piping and controls or burner geometry using internal flue gas recirculation systems to lower NOx emission levels. It would be further desirable if such an apparatus and method for a burner assembly could be provided that would not require undesirably high amounts of excess oxygen to reduce NOx emission levels. It would be still further desirable if such an apparatus and method for a burner assembly could be provided that would not have undesirably low combustion efficiencies. In addition, it would be desirable if such an apparatus and method for a burner assembly could be provided that would not produce undesirable acoustic coupling. It would also be desirable if such an apparatus and method for a burner assembly could be provided that would not dispose the burner head within the combustion chamber.

ADVANTAGES OF THE PREFERRED EMBODIMENTS OF THE INVENTION

Accordingly, it is an advantage of the preferred embodiments of the invention claimed herein to provide an apparatus and method for a burner assembly that does not produce excessive amounts of the undesirable combination of nitric oxide (NO) and nitrogen dioxide (NO2) (collectively NOx). It is also an advantage of the preferred embodiments of the invention claimed herein to provide an apparatus and method for a burner assembly that does not require either expensive and complex external flue gas recirculation piping and controls or burner geometry using internal flue gas recirculation systems to lower NOx emission levels. It is another advantage of the preferred embodiments of the invention claimed herein to provide an apparatus and method for a burner assembly that does not require undesirably high amounts of excess oxygen to reduce NOx emission levels. It is still another advantage of the preferred embodiments of the invention claimed herein to provide an apparatus and method for a burner assembly that does not have undesirably low combustion efficiencies. It is yet another advantage of the preferred embodiments of the invention claimed herein to provide an apparatus and method for a burner assembly that does not produce undesirable acoustic coupling. In addition, it is an advantage of the preferred embodiments of the invention claimed herein to provide an apparatus and method for a burner assembly that does not dispose the burner head within the combustion chamber.

Additional advantages of the preferred embodiments of the invention will become apparent from an examination of the drawings and the ensuing description.

EXPLANATION OF THE TECHNICAL TERMS

The use of the terms "a," "an," "the," and similar terms in the context of describing the invention are to be construed to cover both the singular and the plural, unless otherwise indicated herein or clearly contradicted by context. The terms "comprising" "having," "including," and "containing" are to be construed as open-ended terms (i.e., meaning "including, but not limited to,") unless otherwise noted. The terms "substantially," "generally," and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "attached," "connected," and "interconnected," refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as," "preferred," and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. Several terms are specifically defined herein. These terms are to be given their broadest reasonable construction consistent with such definitions, as follows:

As used herein, the term "fuel lean" means a mixture of air and fuel in which an amount of excess oxygen (O2) is added to the mixture. The term "fuel lean" contemplates that the amount of excess oxygen (O2) added to the mixture of air and fuel is approximately three percent (3%) or more.

As used herein, the term "fuel rich" means a mixture of air and fuel in which less than approximately three percent (3%) excess oxygen (O2) is added to the mixture.

SUMMARY OF THE INVENTION

Embodiments of the present invention include a burner assembly comprising a blower housing, a blower that is adapted to supply air to the burner assembly, a blast tube having a longitudinal axis, and a fuel source that is adapted to supply fuel to the burner assembly. The preferred burner assembly also comprises a center tube that is substantially parallel to the longitudinal axis and adapted to convey a center tube air and fuel mixture to a center tube burner end opening and a plurality of premix tubes, each of which is substantially parallel to the longitudinal axis and adapted to convey a premix tube air and fuel mixture to a premix tube burner end opening. The preferred burner assembly further comprises a diffuser that is disposed in the center tube near the center tube burner end opening and a nozzle that is disposed in the center tube substantially perpendicular to the diffuser. In the preferred burner assembly, the center tube air and fuel mixture is fuel rich and the premix tubes air and fuel mixtures are fuel lean.

Embodiments of the present invention include a method for a burner assembly. The preferred method comprises providing a burner assembly. The preferred burner assembly comprises a blower housing, a blower that is adapted to supply air to the burner assembly, a blast tube having a longitudinal axis, and a fuel source that is adapted to supply fuel to the burner assembly. The preferred burner assembly also comprises a center tube that is substantially parallel to the longitudinal axis and adapted to convey a center tube air and fuel mixture to a center tube burner end opening and a plurality of premix tubes, each of which is substantially parallel to the longitudinal axis and adapted to convey a premix tube air and fuel mixture to a premix tube burner end opening. The preferred burner assembly further comprises a diffuser that is disposed in the center tube near the center tube burner end opening and a nozzle that is disposed in the center tube substantially perpendicular to the diffuser. In the preferred burner assembly, the center tube air and fuel mixture is fuel rich and the plurality of premix tubes air and fuel mixtures are fuel lean. The preferred method further comprises burning the center tube air and fuel mixture and the plurality of premix tubes air and fuel mixtures.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figures 1, 1A:
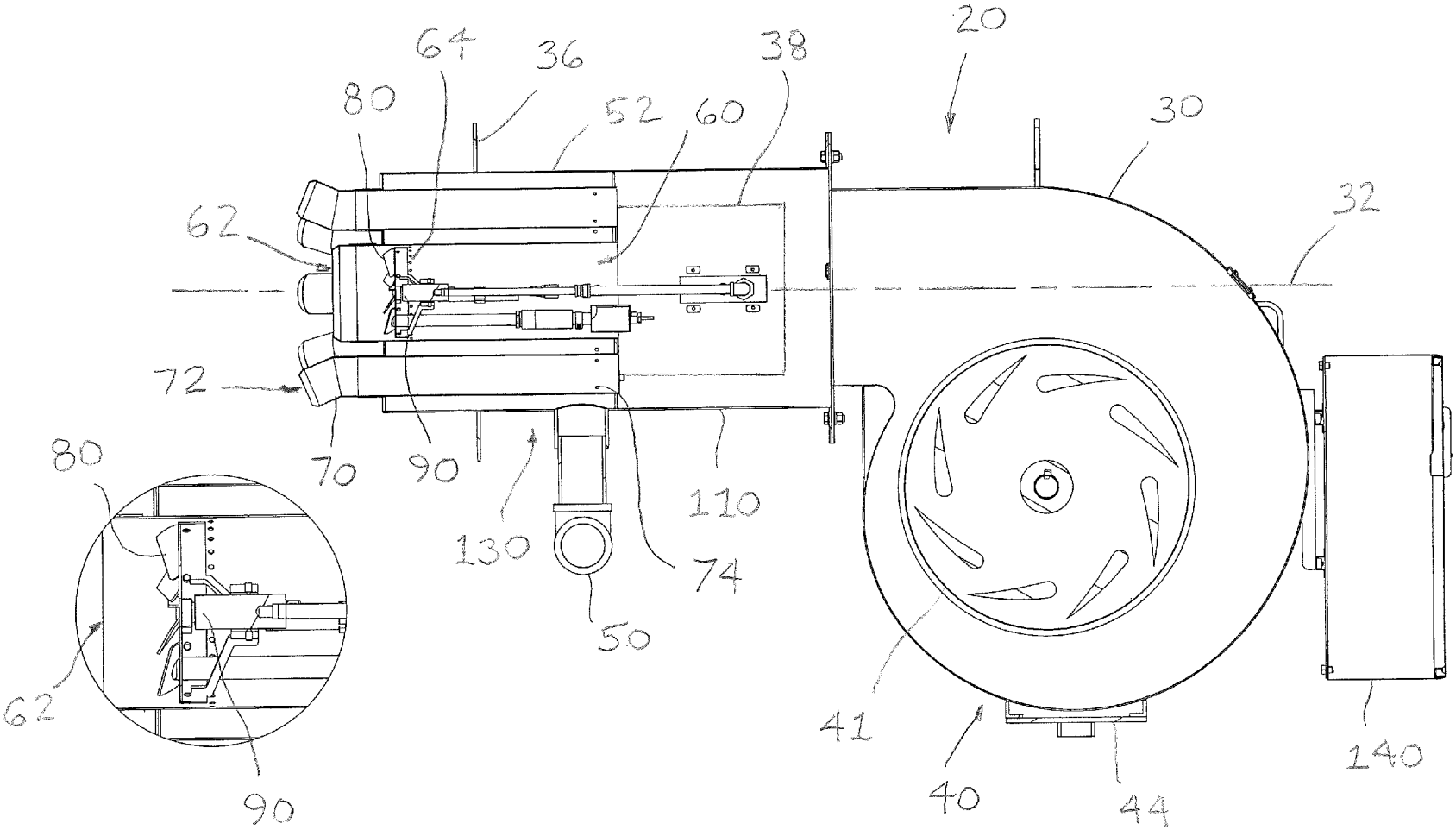
FIG. 1 is a partial sectional side view of the preferred embodiment of the burner assembly in accordance with the present invention.
FIG. 1A is a detailed partial sectional side view of the preferred nozzle and diffuser of the burner assembly illustrated in FIG. 1.
Figure 2:
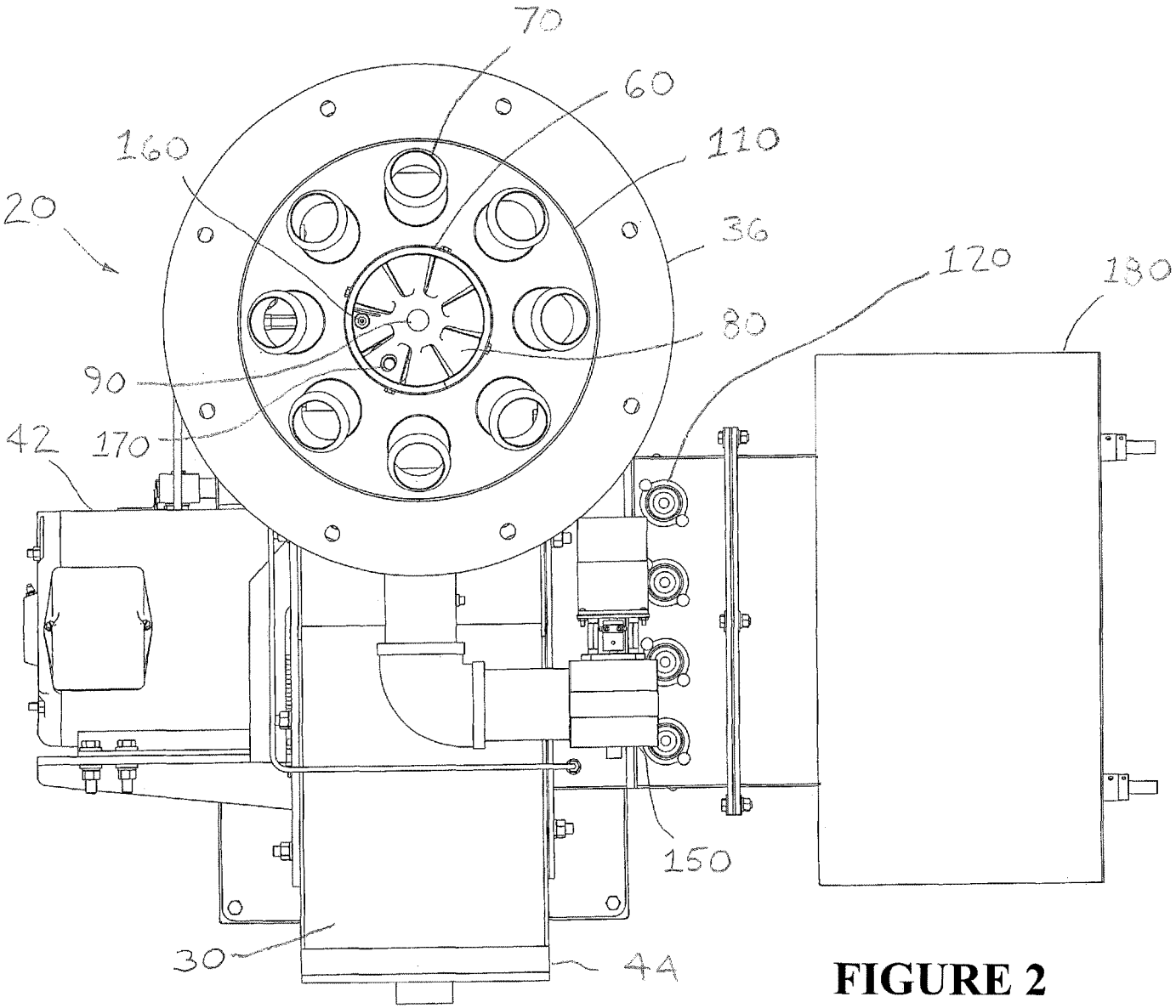
FIG. 2 is a burner end view of the preferred burner assembly illustrated in FIGS. 1 and 1A.

Referring now to the drawings, the preferred embodiment of the burner assembly in accordance with the present invention is illustrated by FIGS. 1 through 2. Referring now to FIG. 1, a partial sectional side view of the preferred embodiment of the burner assembly in accordance with the present invention is illustrated. As shown in FIG. 1, the preferred burner assembly is designated generally by reference numeral 20. Preferred burner assembly 20 comprises blower housing 30. Substantially surrounding preferred blast tube 110 is mounting flange 36. Preferred blast tube 110 has longitudinal axis 32 and comprises access cover 38. Preferred access cover 38 is adapted to permit easy access to the diffuser, the pilot, and the scanner.

Still referring to FIG. 1, preferred burner assembly 20 also comprises blower 40. Preferred blower is adapted to supply air to blower housing 30 and more particularly toward the burner end openings. Preferred blower 40 may be integrally mounted on burner assembly 20 or remotely located away from the burner assembly. Preferred blower 40 also comprises blower wheel 41 and mounting bracket 44. Preferably, the air supplied by blower 40 is ambient air. Preferred burner assembly 20 further comprises fuel source 50. Preferred fuel source is adapted to supply fuel to burner assembly 20 and more particularly to the burner end openings. Preferably, fuel is conveyed to preferred burner assembly 20 via fuel manifold 52. Preferred fuel manifold 52 comprises a plurality of orifices that are in fluid communication with the center tube and the plurality of premix tubes. Preferably, the fuel supplied by fuel source 50 is gaseous fuel. It is contemplated within the scope of the invention, however, that the fuel supplied by fuel source 50 is liquid fuel.

Still referring to FIG. 1, preferred burner assembly 20 still further comprises center tube 60. Preferred center tube 60 is substantially parallel to longitudinal axis 32 and is adapted to convey a center tube air and fuel mixture toward center tube burner end opening 62. Preferred center tube 60 comprises a plurality of center tube orifices 64 for receiving fuel from fuel manifold 52. In addition, preferred burner assembly 20 comprises a plurality of premix tubes 70. Preferred plurality of premix tubes 70 are substantially parallel to longitudinal axis 32 and each of them is adapted to convey a premix tube air and fuel mixture toward one of the premix tube burner end openings 72. Each of preferred premix tubes 70 comprises a plurality of premix tube orifices 74 for receiving fuel from fuel manifold 52.

Still referring to FIG. 1, preferred burner assembly 20 also comprises diffuser 80. Preferred diffuser 80 is disposed in center tube 60 near center tube burner end opening 62. Preferred burner assembly 20 further comprises nozzle 90. Preferred nozzle 90 is disposed in center tube 60 substantially perpendicular to diffuser 80. Preferred nozzle 90 may be a gaseous fuel or liquid fuel nozzle.

Still referring to FIG. 1, preferred burner assembly 20 further comprises burner housing or blast tube 110 which is adapted to convey air from blower 40 toward the burner end openings, burner head 130 which is disposed upstream from the burner end openings, and control panel 140 which is adapted to interface with a user to control the operation of the burner assembly.

Still referring to FIG. 1, in preferred burner assembly 20, the center tube air and fuel mixture is fuel rich and the premix tubes air and fuel mixtures are fuel lean.

Referring now to FIG. 1A, a detailed partial sectional side view of preferred center tube burner end opening 62, diffuser 80, and nozzle 90 of burner assembly 20 is illustrated.

Referring now to FIG. 2, a burner end view of preferred burner assembly 20 is illustrated. As shown in FIG. 2, preferred burner assembly 20 comprises blower housing 30, mounting flange 36, blower motor 42, mounting bracket 44, center tube 60, a plurality of premix tubes 70, diffuser 80, damper 120 which is adapted to control the flow of air from blower 40 toward the burner end openings, fuel control valve 150 which is adapted to control the flow of fuel from fuel source 50 to the burner assembly, pilot 160 which is adapted to provide a means for igniting a burner flame, and scanner 170 which is adapted to verify that a pilot flame is produced before introducing the main fuel and thereafter verify that the main flame is produced. Preferred scanner 170 may use Infrared, Ultraviolet, flamerod sensing, or any other suitable technology for verifying the pilot and main flames. Preferred burner assembly 20 still further comprises silencer 180 which is adapted to reduce noise produced by the burner assembly.

Embodiments of the invention include a method for a burner assembly. The preferred method comprises providing a burner assembly as described above in detail. The preferred method also comprises burning the center tube air and fuel mixture and the plurality of premix tubes air and fuel mixtures. In other preferred embodiments of the method of the invention, the method further comprises mixing the center tube air and fuel mixture in the center tube, mixing the plurality of premix tubes air and fuel mixtures in each of the plurality of premix tubes, and mixing the center tube air and fuel mixture with the plurality of premix tubes air and fuel mixtures near the burner end openings. In other preferred embodiments of the method of the invention, the method still further comprises attaching a burner flame to the diffuser and conveying the fuel to the center tube and the plurality of premix tubes via a manifold.

In operation, several advantages of the preferred embodiments of the burner assembly are achieved. For example, the preferred embodiments of the burner assembly do not produce excessive amounts of the undesirable combination of nitric oxide (NO) and nitrogen dioxide (NO2) (collectively NOx). The preferred embodiments of the burner assembly also do not require either expensive and complex external flue gas recirculation piping and controls or burner geometry using internal flue gas recirculation systems to lower NOx emission levels. The preferred embodiments of the burner assembly further do not require undesirably high amounts of excess oxygen to reduce NOx emission levels. The preferred embodiments of the burner assembly still further do not have undesirably low combustion efficiencies. In addition, the preferred embodiments of the burner assembly do not produce undesirable acoustic coupling. The preferred embodiments of the burner assembly also do not dispose the burner head within the combustion chamber.

Additionally, in operation, combustion air from the blower is conveyed to the blast tube where it enters into the burner head. Uniform air flow is conveyed to each of the plurality of premix tubes and toward the premix tubes burner end openings. Uniform air flow is also conveyed to the center tube and toward the center tube burner end opening. In addition, gaseous fuel is conveyed to the gas manifold where it exits the manifold through a plurality of orifices. More particularly, gaseous fuel is conveyed to the plurality of premix tubes via a plurality of premix tube orifices, mixed with the combustion air in the premix tubes, and the mixture is conveyed toward the premix tubes burner end openings. A well-mixed lean fuel and air mixture is conveyed in each of the plurality of premix tubes. Simultaneously, gaseous fuel from the manifold enters the center tube via a plurality of center tube orifices and mixes with the combustion air in the center tube. It is also contemplated within the scope of the invention that the gaseous fuel may be conveyed via a center gas gun delivery system in order to more precisely control the fuel to air ratio. The center tube air and fuel mixture is conveyed through the flame stabilizing diffuser to produce a fuel rich stabilized center flame. The well-mixed fuel lean air mixtures exit the plurality of premix tubes burner end openings where the lean fuel mixtures are ignited by the fuel rich stabilized center flame. The well-mixed fuel lean mixture flames produce extremely low NOx levels, and the fuel rich stabilized flame is established on the diffuser.

More particularly, the high-velocity plurality of premix tubes surrounding the center tube produce very low NOx levels, e.g. less than thirty parts per million (30 ppm) and typically less than ten parts per million (10 ppm), due to operating at a relatively high level of oxygen (O2) (fuel lean). The center tube operates at a relatively low level of oxygen (O2) (fuel rich) or even at a sub-stoichiometric ratio and produces normal NOx levels, e.g. greater than approximately fifty parts per million (50 ppm). When the fuel lean and fuel rich mixtures are slowly combined, the sum of the flue gas results in low NOx levels (e.g., less than 30 ppm) and relatively low excess oxygen (3% or less). Typically, 3% excess oxygen is the desired level to maximize combustion efficiency while still having sufficient excess oxygen to ensure complete combustion.

In addition, the geometry of the plurality of premix tubes minimizes the risk of flashback, and the combination of the plurality of premix tubes with the standard nozzle mix burner defined in part by center tube minimizes the risk of acoustic coupling which premix burners experience. Further, because the fuel rich standard nozzle mix burner defined in part by the center tube has a very low oxygen level, the temperature of the flame it produces is lower than normal and it produces somewhat lower NOx levels. The fuel lean plurality of premix tubes produce very low NOx levels. Still further, the excess oxygen from the plurality of premix tubes is somewhat delayed in combining with the fuel rich mixture of the center burner and this further reduces NOx levels. The preferred embodiments of the burner assembly of the invention also produce almost no carbon monoxide (CO).

In testing preferred embodiments of the invention on multiple different-sized burner assemblies, the following results were achieved in one exemplary test:

Rate: 6,900 Mbuth
Excess O2: 2.5%
NOx: 25.2 ppm
CO: 0%

When the excess O2 level was increased to 3%, the NOx levels were reduced to 24.5 ppm.

As demonstrated above, the combination of a fuel rich center nozzle mix burner, which provides stability for the entire assembly and an flame in need of oxygen, and the plurality of pre-mix burners surrounding the center nozzle mix burner, which produce extremely low NOx levels and provide the oxygen needed by the center burner, produce low NOx levels with a relatively low amount of excess oxygen.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A burner assembly comprising:

a blast tube having a longitudinal axis and having a blast tube end;

a blower configured to supply air to the blast tube;

a center tube disposed within the blast tube, oriented substantially parallel to the longitudinal axis, and terminating at a center tube burner end opening located proximate the blast tube end, wherein the center tube is in fluid communication with the blast tube so as to receive a first air portion of the air supplied to the blast tube by the blower;

a plurality of premix tubes disposed within the blast tube and encircling the center tube, each premix tube of the plurality of premix tubes oriented substantially parallel to the longitudinal axis and terminating at a premix tube burner end opening located proximate the blast tube end, wherein each premix tube of the plurality of premix tubes is in fluid communication with the blast tube so as to receive a second air portion of the air supplied to the blast tube by the blower;

a plurality of center tube orifices provided in the center tube at a first longitudinal position along the longitudinal axis, each of the center tube orifices configured to receive fuel and to provide fuel received to the center tube;

a plurality of premix tube orifices provided in each of the plurality of premix tubes and located at a second longitudinal position along the longitudinal axis that is upstream of the plurality of center tube orifices such that the center tube orifices are longitudinally located between the blast tube end and the plurality of premix tube orifices, wherein each of the plurality of premix tube orifices is configured to receive fuel and to provide fuel received to each respective one of the plurality of premix tubes;

a fuel source configured to supply a first fuel portion to the center tube via the plurality of center tube orifices and a second fuel portion to each of the plurality of premix tubes via the plurality of premix tube orifices; and a pilot for igniting air and fuel mixtures, wherein the first air portion mixes with the first fuel portion in the center tube to form a fuel rich center tube air and fuel mixture that travels through the center tube toward the center tube burner end opening and longitudinally past the pilot so as to be ignited by the pilot to produce a fuel rich center flame, and wherein the second air portion mixes with the second fuel portion in each of the premix tubes to form a fuel lean premix tube air and gaseous fuel mixture that travels through the premix tube toward the premix tube burner end opening and longitudinally past the pilot so as to be ignited by the center flame to produce a fuel lean mixture flame.

2. The burner assembly of claim 1 wherein the air comprises ambient air.

3. The burner assembly of claim 1 wherein the fuel comprises gaseous fuel.

4. The burner assembly of claim 1 wherein the fuel comprises liquid fuel.

5. A method of operating a burner assembly to product a low NOx flame, the method comprising the steps of:

providing a burner assembly comprising:

a blast tube having a longitudinal axis and having a blast tube end;

a blower;

a center tube disposed within the blast tube, oriented substantially parallel to the longitudinal axis, and terminating at a center tube burner end opening located proximate the blast tube end, wherein the center tube is in fluid communication with the blast tube;

a plurality of premix tubes disposed within the blast tube and encircling the center tube, each premix tube oriented substantially parallel to the longitudinal axis and terminating at a premix tube burner end opening located proximate the blast tube end, wherein each of the plurality of premix tubes is in fluid communication with the blast tube;

a plurality of center tube orifices provided in the center tube at a first longitudinal position along the longitudinal axis;

a plurality of premix tube orifices provided in each of the plurality of premix tubes and located at a second longitudinal position along the longitudinal axis that is upstream of the plurality of center tube orifices such that the center tube orifices are longitudinally located between the blast tube end and the plurality of premix tube orifices;

a fuel source; and a pilot;

with the blower, supplying air to the blast tube;

with the center tube, receiving a first air portion of the air supplied by the blower;

with each of the plurality of premix tubes, receiving a second air portion of the air supplied by the blower;

with the fuel source, providing a first fuel portion to the center tube;

with the center tube, via the plurality of center tube orifices, receiving the first fuel portion;

with the fuel source, providing a second fuel portion to each of the plurality of premix tubes;

with each of the plurality of premix tubes, via the plurality of premix tube orifices, receiving the second fuel portion;

in the center tube, mixing the first air portion with the first fuel portion to form a fuel rich center tube air and fuel mixture that travels through the center tube toward the center tube burner end opening and longitudinally past the pilot;

with the pilot, igniting the fuel rich center tube air and fuel mixture to produce a fuel rich center flame;

in each of the plurality of premix tubes, mixing the second air portion with the second fuel portion to form a fuel lean premix tube air and gaseous fuel mixture that travels through the premix tube toward the premix tube burner end opening and longitudinally past the pilot;

with the fuel rich center flame, igniting the fuel lean premix tube air and gaseous fuel mixtures to produce a low NOx flame.

6. The method of claim 5 further comprising mixing the first air portion and the first fuel portion in the center tube before the first air portion and the first fuel portion reaches a longitudinal position of the pilot.

7. The method of claim 5 further comprising mixing the second air portion and second fuel portion in each of the plurality of premix tubes before the second air portion and second fuel portion reaches a longitudinal position of the pilot.

8. The method of claim 5 wherein the pilot comprises a burner flame, the method further comprising the step of attaching the burner flame to a diffuser located in the center tube.

9. The method of claim 5 further comprising conveying the fuel to the center tube and the plurality of premix tubes via a manifold.

10. The method of claim 5 wherein the burner assembly further comprises a nozzle.

11. The burner assembly of claim 1 wherein the plurality of premix tubes are arranged in a ring surrounding the center tube when viewed along the longitudinal axis.

* * * * *